US009016902B1

(12) United States Patent
Lin et al.

(10) Patent No.: US 9,016,902 B1
(45) Date of Patent: Apr. 28, 2015

(54) ILLUMINATING BUILDING BLOCK WITH HIGH LIGHT TRANSMISSION

(71) Applicant: Longmen Getmore Polyurethane Co., Ltd, Guangdong (CN)

(72) Inventors: Chia-Yen Lin, Guangdong (CN); Yaping Feng, Hengnan County (CN)

(73) Assignee: Longmen Getmore Polyurethane Co., Ltd, Guangdong (CN)

( * ) Notice: Subject to any disclaimer, the term of this patent is extended or adjusted under 35 U.S.C. 154(b) by 0 days.

(21) Appl. No.: 14/463,732

(22) Filed: Aug. 20, 2014

(30) Foreign Application Priority Data

Jul. 22, 2014 (CN) ..... 2014 1 0351688

(51) Int. Cl.

| | |
|---|---|
| ***F21V 21/088*** | (2006.01) |
| ***F21V 33/00*** | (2006.01) |
| ***F21V 15/01*** | (2006.01) |
| ***F21V 23/06*** | (2006.01) |
| ***F21V 23/00*** | (2006.01) |

(52) U.S. Cl.
CPC ..... *F21V 33/008* (2013.01); *F21V 15/01* (2013.01); *F21V 23/06* (2013.01); *F21V 23/004* (2013.01)

(58) Field of Classification Search
CPC ..... F21Y 2101/02; H01L 2224/48091; H01L 2924/0002; H01L 2924/00; H05K 1/189; G02B 6/0068; G02B 6/0083; G02F 1/133615
USPC ..... 362/367, 374, 375, 800, 457, 458, 646, 362/647, 648, 649, 650, 651, 652, 653, 654, 362/655, 656, 657, 658, 659, 184, 185, 186, 362/190, 191, 200, 201, 219, 217, 221, 222, 362/223, 224, 225, 249.01, 249.02, 249.03, 362/249.04, 249.05, 249.06, 249.07, 362/249.08, 249.09, 249.1, 249.11, 249.12, 362/249.13, 249.14, 249.15, 249.16, 362/249.17, 249.18, 249.19, 311.01, 362/311.02, 311.03, 311.04, 311.05, 362/311.06, 311.07, 311.08, 311.09, 311.1, 362/311.11, 311.12, 311.13, 311.14, 311.15
See application file for complete search history.

(56) References Cited

U.S. PATENT DOCUMENTS

2012/0081898 A1* 4/2012 Cave et al. ..... 362/249.01
2012/0293729 A1* 11/2012 Yoshikawa ..... 348/739

* cited by examiner

*Primary Examiner* — Anh Mai
*Assistant Examiner* — Fatima Farokhrooz
(74) *Attorney, Agent, or Firm* — Lin & Associates IP, Inc.

(57) ABSTRACT

An illuminating building block with high light transmission includes a base, a top cover, a circuit board and at least one illuminating member. The illuminating building block uses electric connection members connected with the circuit board to electrically connect with the adjacent illuminating building block. Because the electric connection members are disposed by the top cover and a side wall, the electric connection members do not block the light emitted from the illuminating member. Thus, the illuminating building block is provided with the characteristic of high light transmission. Moreover, due to elasticity of the electric connection members, the electric connection members are pressed against the circuit board of the adjacent illuminating building block. Therefore, the electric connection between connected illuminating building blocks is more secure.

14 Claims, 14 Drawing Sheets

ILLUMINATING BUILDING BLOCK WITH HIGH LIGHT TRANSMISSION

CROSS-REFERENCE TO RELATED APPLICATION

This application claims the priority of Chinese patent application No. 201410351688.8, filed on Jul. 22, 2014, which is incorporated herewith by reference

BACKGROUND OF THE INVENTION

1. Field of the Invention

The present invention relates generally to an illuminating building block, and in particular to an illuminating building block with high light transmission.

2. The Prior Arts

A conventional building block includes a base, a plurality of electric connection posts and a top cover. The base has a plurality of recesses defined in a bottom thereof and a circuit board disposed on a top of the base. The conductive circuit is printed on the circuit board and an illuminating member is mounted on the circuit board. The electric connection posts are soldered or mounted on the circuit board and electrically connected with the illuminating member. Each of the electric connection posts includes a positive conducting assembly and a negative conducting assembly made of conductive metal. The top cover is mounted on the top of the base and includes a plurality of studs corresponding to the electric connection posts. The electric connection posts respectively extend into the hollow studs and can be electrically connected with the electric connection posts of another building block. Moreover, the top cover is hollow and light transmittable. The light emitted from the illuminating member disposed in the building block can penetrate through the top cover to light up the building block.

Although the conventional building block is equipped with an illumination function, the electric connection posts disposed around the illuminating member would obstruct the traveling path of light. Therefore, the efficiency of the illumination is poor and the angles of the illumination are limited. Moreover, the electric connection posts are made of conductive metal and thus the cost of material is quite high. The positive conducting assembly and the negative conducting assembly are provided in each of the electric connection posts, and thus the structure of electric connection is complicate. Not only time and cost consuming to manufacture, but also the conductive circuit is easily damaged, which results in short circuit and failure of illumination. Therefore, the conventional illuminating building blocks are not cost effective and lighting effective.

SUMMARY OF THE INVENTION

A primary objective of the present invention is to provide an illuminating building block that prevents electric connection posts from blocking the light of the illuminating member, simplifies structures of the electric connection posts, saves the cost of manufacturing the illuminating building block, and provides a structure that is less likely to be damaged.

In order to achieve the objectives, an illuminating building block with high light transmission according to the present invention includes: a base having at least one recess defined therethrough; a top cover being hollow and light transmittable, mounted on the base, including a top portion and side walls, the top portion including at least one hollow stud corresponding to the recess of the base, the side walls being extended from edges of the top portion to edges of the base; a circuit board disposed on a top of the base, including at least one electrode circuit corresponding to the recesses of the base, the electrode circuit including a positive electrode circuit and a negative electrode circuit, the positive electrode circuit and the negative electrode circuit respectively connected with a set of electric connection members that are extended away from the base, each of the electric connection members including a projection portion, a connection portion and at least one elastic piece, the projection portion contacted with the electrode circuit of the circuit board, the connection portion connecting the projection portion with the elastic piece, the elastic piece projected to an inside of the hollow stud; and at least one illuminating member mounted on the electrode circuit of the circuit board.

The advantage of the present invention is electric connection members disposed at a side of electrode circuits replace the conventional electric connection posts that are located in the building block and would block the light. Thus, the electric connection members according to the present invention simplify the structures of the electric connection posts, save the cost of manufacturing the illuminating building blocks, and increase the range of the illumination of the illuminating members.

Preferably, the elastic pieces are projected out of the studs of the top cover and a height of the hollow stud plus a portion of the elastic piece that is projected out of the hollow stud is greater than a depth from a bottom of the recess of the base to the circuit board. Because the elastic pieces are projected out of the studs, the power can be transmitted from the electrode circuits of the lower building block through the projection portions, the connection portions and the elastic pieces to the electrode circuits of the upper building block. Thus, the upper illuminating building block is electrically connected with the lower illuminating building block and both of the illuminating blocks are capable of emitting light.

Preferably, the positive electrode circuit and the negative electrode circuits are arranged as concentric circles. The electrode circuit disposed at the outer circumference has an opening. Another electrode circuit disposed at the center of circles is extended from the center of the circles through the opening to the outside of the circles. The electrode circuit passing through the opening is covered with an insulating coating 211 at the opening. Due to the electrode circuits arranged as concentric circles and the hollow studs and the recesses being usually shaped in circles, it makes the electric connection easier when the building blocks are connected with each other. Moreover, the electrode circuits disposed at the outer circumference and at the center of the circles are connected with a set of electric connection members, respectively. Therefore, when two illuminating building blocks are connected by a single hollow stud and a single recess and the connected illuminating building blocks are rotated relative to each other, one of the electric connection members of the lower illuminating building block is rotated about and contacted with the center of the concentric circles of the upper illuminating building block and another electric connection member of the lower illuminating building block is moved along and contacted with the outer circumference of the concentric circles of the upper illuminating building block. During the process of rotation, the insulating coating prevents the electric connection member moving along the outer circumference of the lower illuminating building block from being simultaneously contacted with the electrode circuit disposed at the outer circumference and the electrode circuit disposed at the center of the circles and extended through the opening of the upper illuminating building block, which results in failure of the electric connection.

Preferably, a second circuit board is further provided at the inside of the top cover. The second circuit board includes at least one second electrode circuit. The second electrode circuit includes a second positive electrode circuit and a second negative electrode circuit. The second positive electrode circuit and the second negative electrode circuit are contacted with the electric connection members, respectively. Due to providing two circuit boards, the illuminating building block according to the present invention is provided with more illuminating members, thereby increasing the luminance of the building block.

Preferably, an inside of the top portion of the top cover includes at least one fixing piece and the connection portion of the electric connection member includes at least one fixing hole corresponding to the fixing piece. The fixing piece can be engaged with the fixing hole to connect the electric connection member with the top cover. Therefore, the relative positions of the top cover and the electric connection member is fixed, which makes the structure of the elastic pieces more stable.

Preferably, the elastic piece is a circular arc piece. One end of the circular arc piece is connected with the connection portion and a top of the circular arc piece is projected out of the hollow stud. Due to the top of the circular arc piece projected out of the hollow stud, when the illuminating building blocks are connected with each other, the circular arc piece of the elastic piece is pressed against and contacted with a bottom of the electrode circuit of another illuminating building block. The elastic pieces according to the present invention take the advantage of the characteristic of the elasticity to insure the effective contact between the elastic pieces of one illuminating building block and the electrode circuits of the adjacent illuminating building block. Thus, the broken circuit is less likely to happen.

Preferably, the elastic piece is an elongated piece. The elongated piece has one end connected with the connection portion and is extended from the connection portion in a direction away from the circuit board. A free end of the elongated piece is shaped in a fork and two tips of the fork are right triangles. The tips of the free end of the elastic piece are projected out of the hollow stud. Due to the triangular tips of the elastic piece projected out of the hollow stud, when the illuminating building blocks are connected with each other, the triangular tips of the elastic piece are pressed against and contacted with a bottom of the electrode circuit of another illuminating building block. The elastic pieces according to the present invention take the advantage of the characteristic of the elasticity to insure the effective contact between the elastic pieces of one illuminating building block and the electrode circuits of the adjacent illuminating building block. The function of the triangular tips of the elastic piece is the same as the circular arc piece.

Preferably, the elastic piece is a curved piece. The curved piece has a plurality of U-shaped turns arranged along an extension direction of the hollow stud. The elastic piece includes one end connected with the connection portion and another end having a curved portion projected out of the hollow stud. Due to the U-shaped turns and the folding arrangement, the elasticity of the elastic piece is reinforced. The elastic pieces according to the present invention take the advantage of the characteristic of the elasticity to insure the effective contact between the elastic pieces of one illuminating building block and the electrode circuits of the adjacent illuminating building block. Thus, the broken circuit is less likely to happen.

According to another embodiment, an illuminating building block with high light transmission, comprising: a base having at least one recess defined therethrough; a top cover being hollow and light transmittable, mounted on the base, including a top portion and side walls, the top portion including at least one hollow stud corresponding to the recess of the base, the side walls being extended from edges of the top portion to edges of the base; a circuit board disposed at an inside of the top portion of the top cover, including at least one electrode circuit corresponding to the hollow stud of the top cover, the electrode circuit including a positive electrode circuit and a negative electrode circuit, the positive electrode circuit and the negative electrode circuit respectively connected with a set of electric connection members that are extended away from the top cover, the electric connection member including a projection portion, a connection portion and at least one elastic piece, the projection portion contacted with the electrode circuit of the circuit board, the connection portion connecting the projection portion with the elastic piece, the elastic piece projected to an inside of the hollow stud; and at least one illuminating member mounted on the electrode circuit of the circuit board.

The advantage of the present invention is electric connection members replace the structurally complicated electric connection posts. The illuminating building block with high light transmission according to the present invention not only saves the cost of manufacturing the illuminating building blocks but also increases the range of the illumination of the illuminating members.

Preferably, the elastic pieces are projected out of the recesses of the base and a depth of the recess plus a height of a portion of the elastic piece that is projected out of the recess is greater than a depth from a top of the hollow stud to the circuit board. Because the elastic pieces are projected out of the recesses, the power can be transmitted from the electrode circuits of the upper building block through the projection portions, the connection portions and the elastic pieces to the electrode circuits of the lower building block. Thus, the upper illuminating building block is electrically connected with the lower illuminating building block and both of the illuminating blocks are capable of emitting light.

Preferably, the positive electrode circuit and the negative electrode circuits are arranged as concentric circles. The electrode circuit disposed at the outer circumference has an opening. Another electrode circuit disposed at the center of circles is extended from center of the circles through the opening to the outside of the circles. The electrode circuit passing through the opening is covered with an insulating coating 211 at the opening. Because the electrode circuits are arranged as concentric circles and the hollow studs and the recesses are usually shaped in circles, it makes the electric connection between the illuminating building blocks easier when the illuminating building blocks are connected with each other. Moreover, the electrode circuits disposed at the outer circumference and at the center of the circles are connected with a set of electric connection members, respectively. Therefore, when two illuminating building blocks are connected by a single hollow stud and a single recess and the connected illuminating building blocks are rotated relative to each other, one of the electric connection members of the upper illuminating building block is rotated about and contacted with the center of the concentric circles of the lower illuminating building block and another electric connection member of the upper illuminating building block is moved along and contacted with the outer circumference of the concentric circles of the lower illuminating building block. During the process of rotation, the insulating coating prevents the electric connection member moving along the outer circumference of the upper illuminating building block from being simultaneously contacted with the electrode circuit disposed at the outer circumference and the electrode circuit disposed at the center of the circles and extended through the opening of the lower illuminating building block, which results in failure of the electric connection.

BRIEF DESCRIPTION OF THE DRAWINGS

The present invention will be apparent to those skilled in the art by reading the following detailed description of preferred embodiments thereof, with reference to the attached drawings, in which.

DETAILED DESCRIPTION OF THE PREFERRED EMBODIMENT

Figure 1:
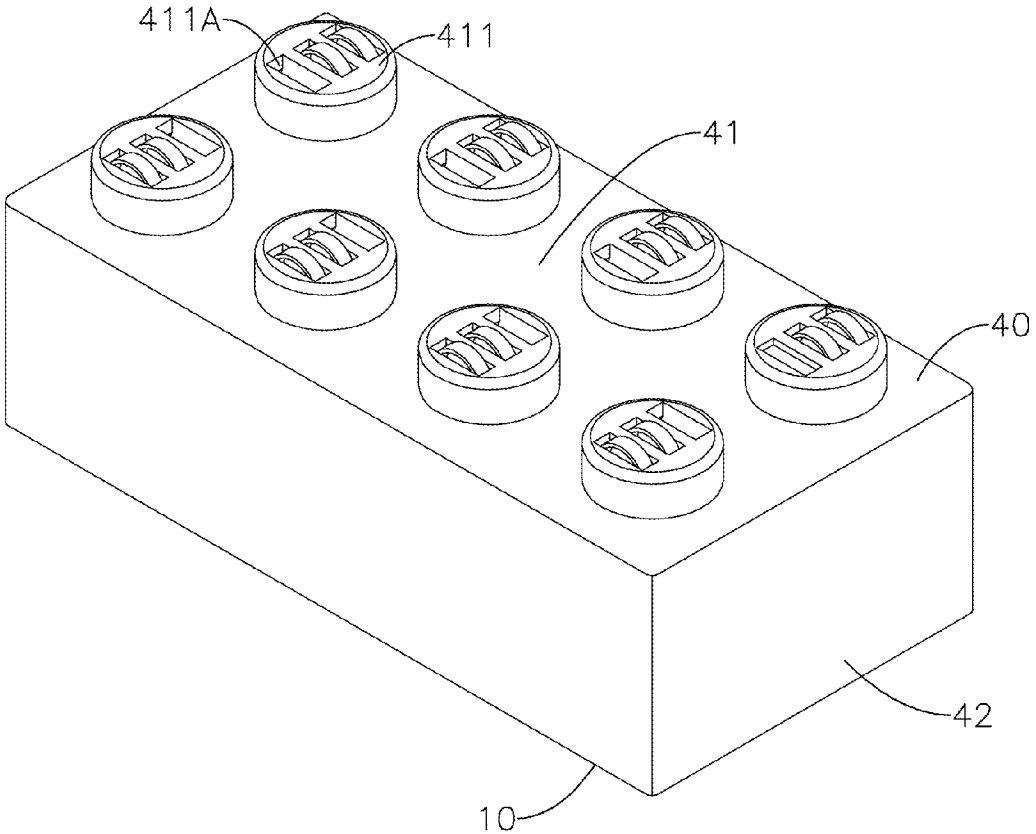
FIG. 1 is a perspective view showing an illuminating building block with high light transmission according to the present invention.
Figure 2:
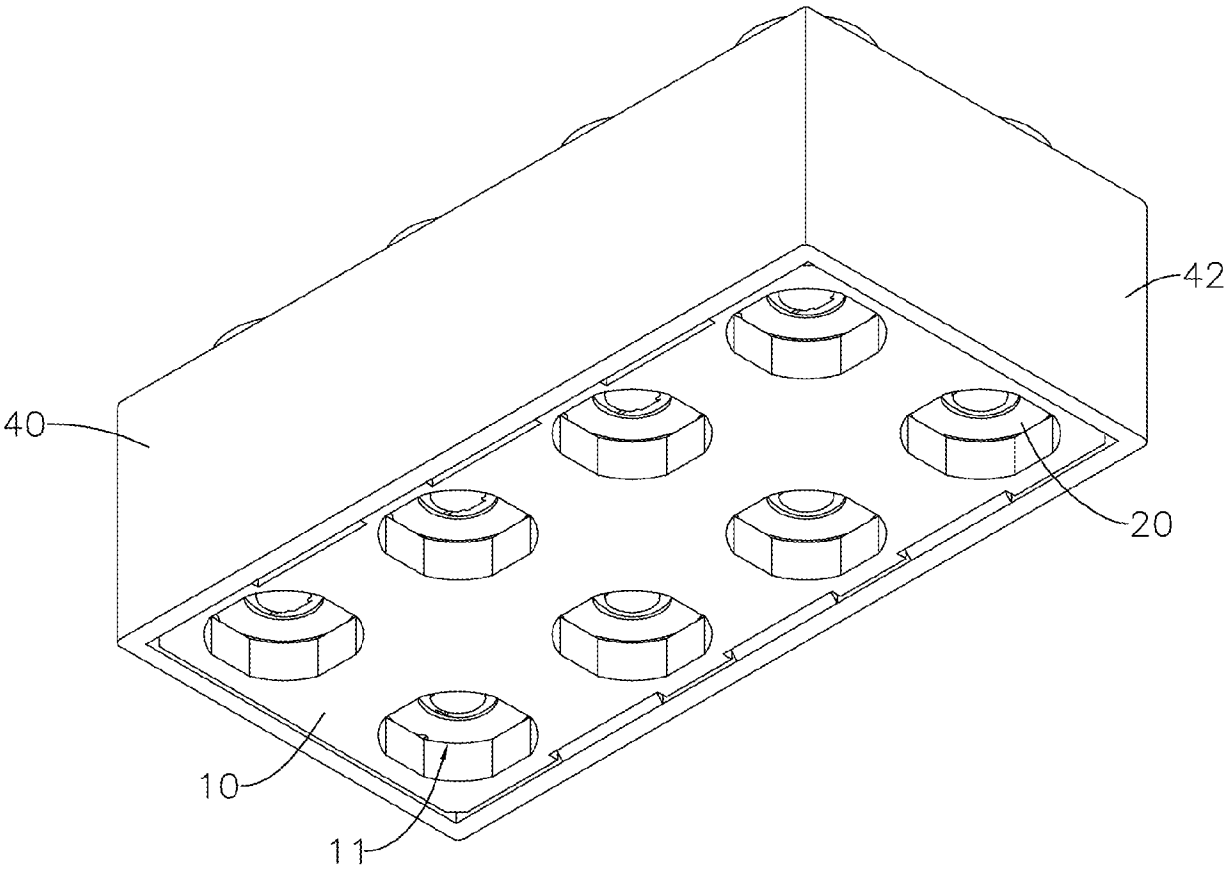
FIG. 2 is a perspective views showing the illuminating building block with high light transmission of FIG. 1 in another viewing angle.
Figure 3:
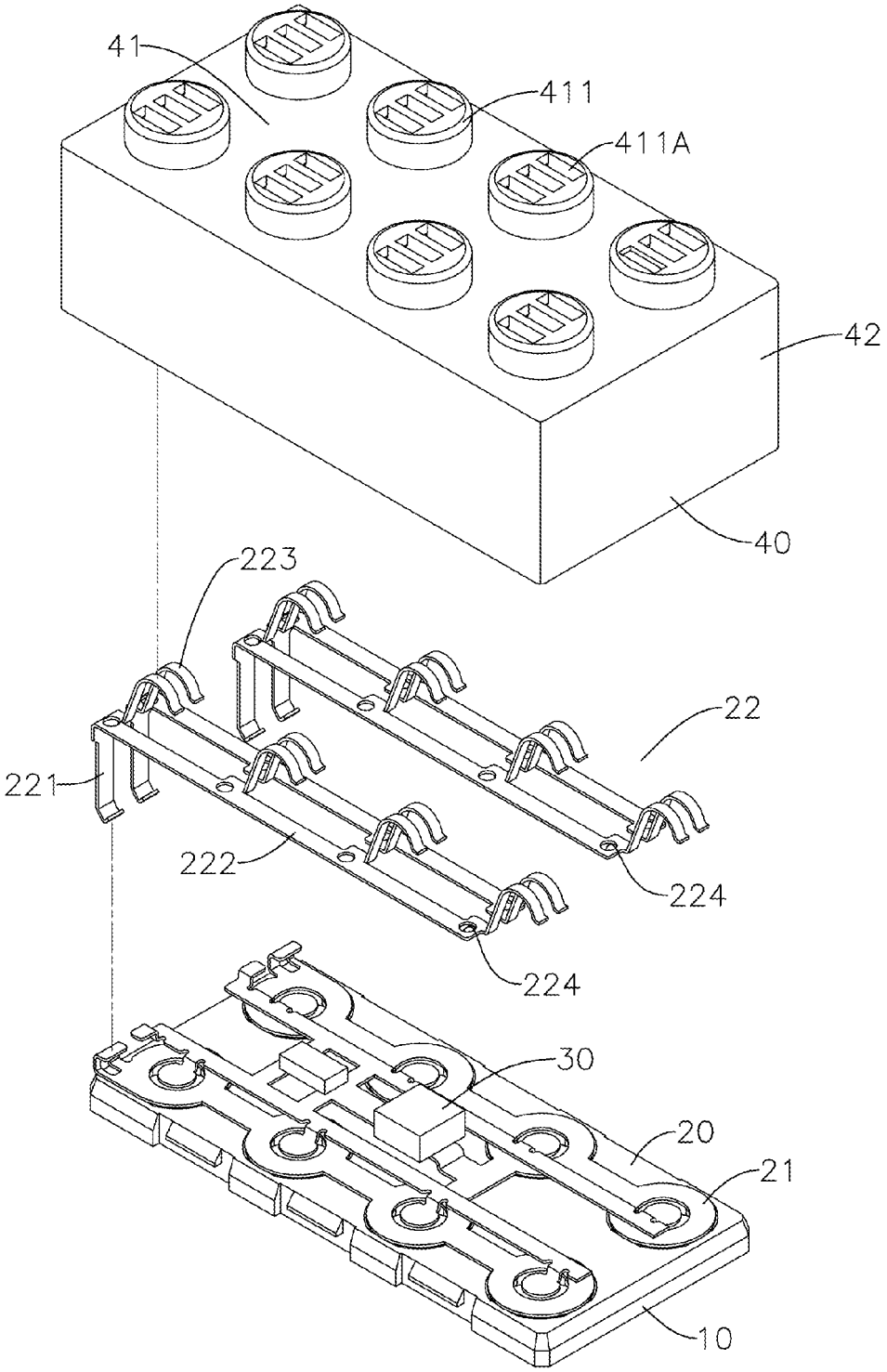
FIG. 3 is an exploded view showing the illuminating building block with high light transmission according to a first preferred embodiment of the present invention.

With reference to FIGS. 1 to 3, an illuminating building block with high light transmission according to a first preferred embodiment of the present invention includes a base 10, a circuit board 20, an illuminating member 30 and a top cover 40.

Referring to FIG. 2, the base 10 is a rectangular plate and includes eight recesses 11 defined therethrough and arranged in a matrix of four by two.

Referring to FIG. 3, the circuit board 20 is disposed on a top of the base 10 and includes eight units of electrode circuits 21. The eight units of electrode circuits 21 are corresponding to the recesses 11 of the base 10, respectively. Each unit of the electrode circuits 21 includes a positive electrode circuit and a negative electrode circuit arranged as concentric circles (one of the electrode circuits is disposed at an outer circumference and another electrode circuit is disposed at a center). The electrode circuits disposed at the outer circumferences are hollow loops connected in series and the electrode circuits disposed at the centers of circles are also connected in series. The positive electrode circuits and the negative electrode circuits are located on different planes. As shown in FIG. 3, the electrode circuits disposed at the centers of circles are extended from centers of the loop electrode circuits to tops of the loop electrode circuits in the directions away from the circuit board 20.

Figure 6:
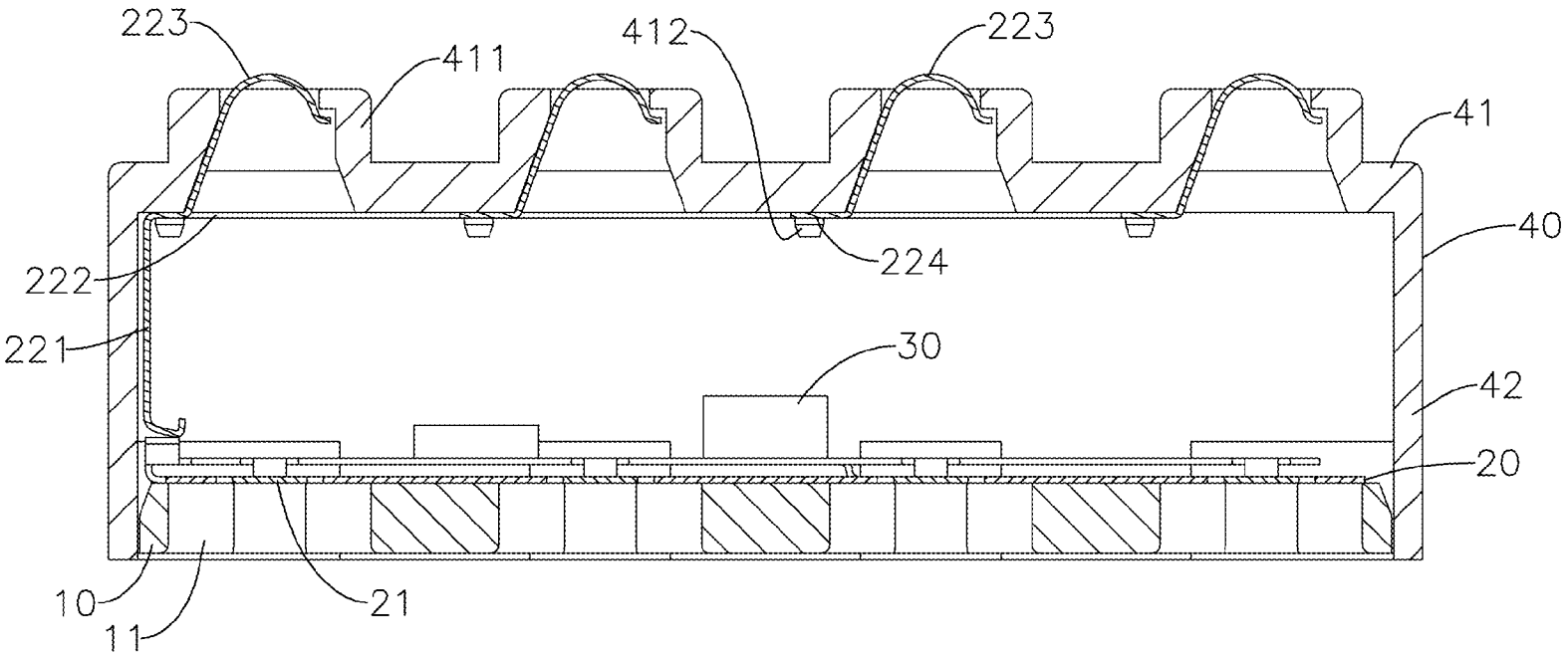
FIG. 6 is a side cross-sectional view showing the illuminating building block with high light transmission according to the first and second preferred embodiment of the present invention.

Referring to FIGS. 3 and 6, two rows of the concentric electrode circuits 21 are connected with two sets of electric connection members 22, respectively. Each set of electric connection members 22 has two electric connection members 22 that are extended away from the base 10. Each of the electric connection members 22 includes a projection portion 221, a connection portion 222 and four elastic pieces 223. Moreover, the projection portion 221 is extended away from the base 10 and disposed adjacent to the top cover 40. As shown in FIG. 6, one end of the projection portion 221 is contacted with and electrically connected with the electrode circuits 21 and the other end of the projection portion 221 is connected with the connection portion 222, thereby electrically connecting the electric connection member 22 with the circuit board 20. The connection portion 222 is extended adjacent to the top cover 40 and in a direction parallel to the circuit board 20. The four elastic pieces 223 are distributed along the connection portion 222 and projected from the connection portion 222 in a direction away from the circuit board 20.

The illuminating member 30 is mounted on the electrode circuits 21 of the circuit board 20. An exterior power source supplies power to the illuminating member 30 through the circuit board 30. Because the electric connection member 22 is disposed adjacent to the top cover 40, an open space is provided between the circuit board 20 and the electric connection member 22, the light emitted from the illuminating member 30 would not be blocked.

The top cover 40 is hollow and light transmittable, which allows the light emitted from the illuminating member 30 to pass through. The top cover 40 is disposed above the base 10 and the circuit board 20. The top cover 40 includes a top portion 41 and side walls 42. The top portion 41 of the top cover 40 includes eight hollow studs 411 corresponding to the concentrically arranged positive and negative electrode circuits of the circuit board 20 and the elastic pieces 223 of the electric connection members 22. The side walls 42 are extended from edges of the top portion 41 of the top cover 40 to edges of the base 10.

Each of the hollow studs 411 includes three elongated holes 411A penetrating through a top of the hollow stud 411. Of the three elongated holes 411A, the elongated hole 411A disposed at a center of the hollow stud 411 and the elongated hole 411A disposed at a side of the hollow stud 411 are corresponding to the elastic pieces 223 of the electric connection member 22 connected with the positive and negative electrode circuits, respectively. The elastic pieces 223 are projected out of the elongated holes 411A, respectively. When the illuminating building blocks are connected with each other, the elastic pieces 223 projected out of the elongated holes 411A disposed at the centers of the hollow studs 411 and the elongated holes 411A disposed at the sides of the hollow studs 411 are corresponding to the electrode circuits 21 disposed at the centers of circles and the electrode circuits 21 disposed at the outer circumferences of the adjacent building block.

Figure 4:
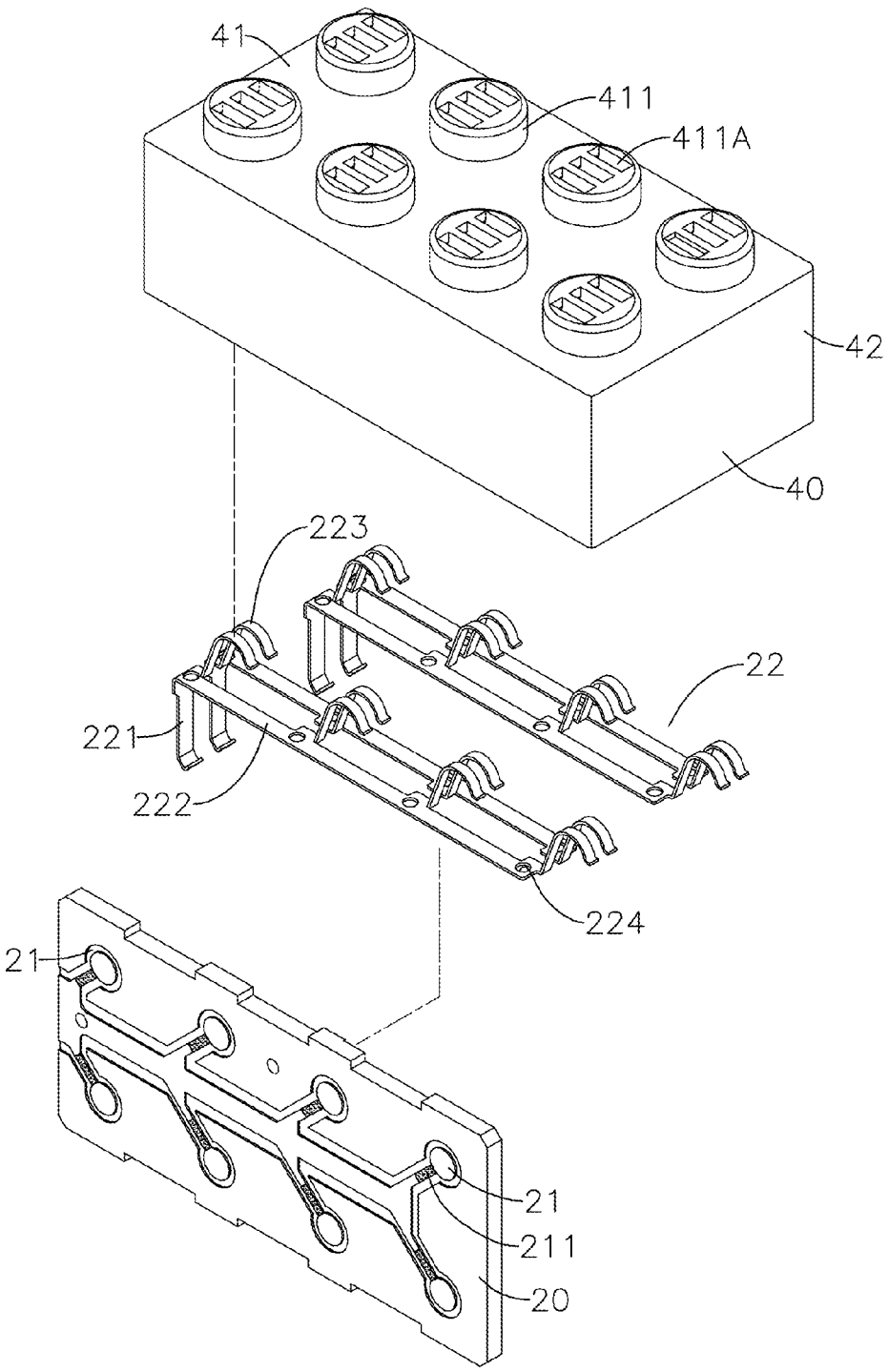
FIG. 4 is a schematic view showing assembling an illuminating building block with high light transmission according to a second preferred embodiment of the present invention.
Figure 5:
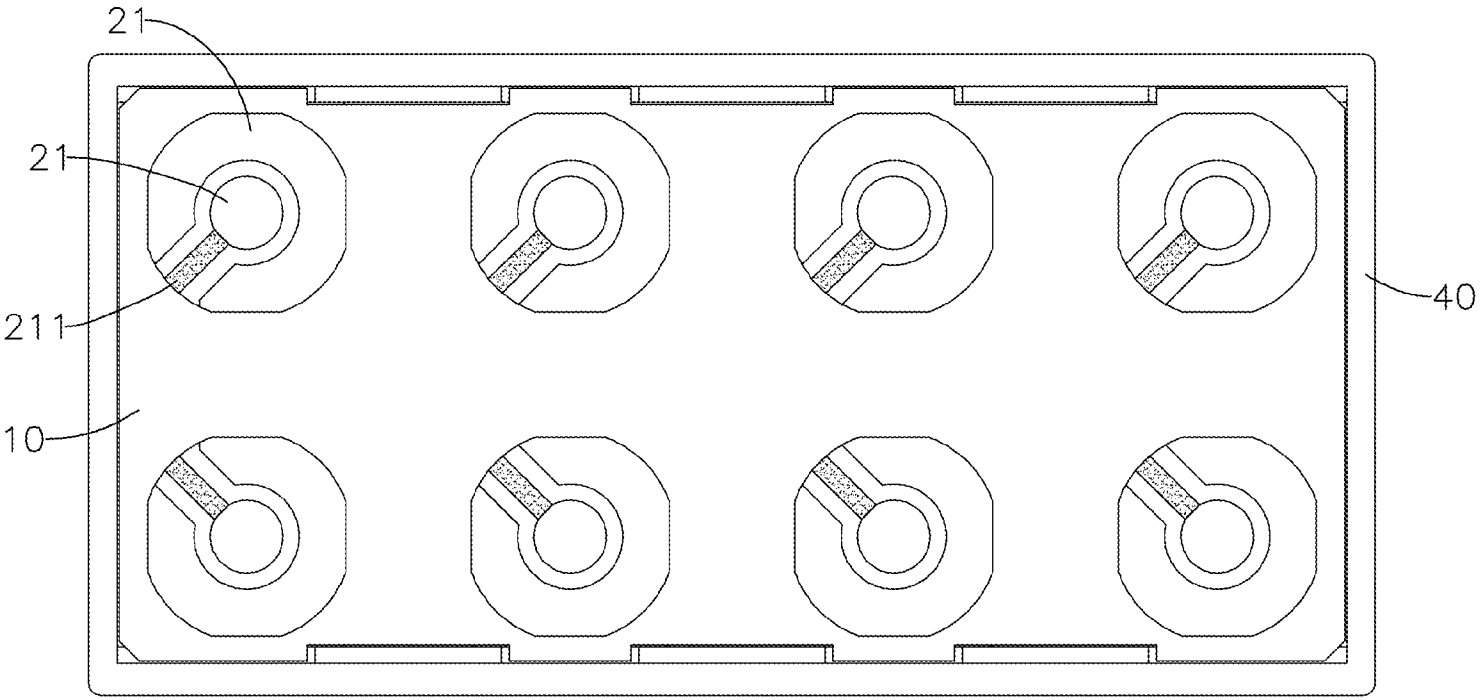
FIG. 5 is a bottom view showing the illuminating building block with high light transmission according to the second preferred embodiment of the present invention.

FIGS. 4 and 5 shows an illuminating building block according to a second preferred embodiment. FIG. 4 is a schematic view showing assembling the top cover 40, the electric connection members 22 and the circuit board 20 together. The circuit board 20 includes eight units of positive and negative electrode circuits 21 connected in series and arranged in a shape of branches. Each unit of the positive and negative electrode circuits are arranged as concentric circles. The electrode circuit 21 disposed at the outer circumference has an opening and thus shaped like a letter C. Another electrode circuit 21 disposed at the center of the circle is extended through the opening to an outside of the concentric circles. The electrode circuit 21 passing through the opening is covered with an insulating coating 211 (shaded area of FIG. 5) at the opening. Therefore, when two illuminating building blocks are connected by a single hollow stud and a single recess and the connected illuminating building blocks are rotated relative to each other, the elastic piece 223 projected out of the elongated hole 411A disposed at the center of the hollow stud 411 of the lower illuminating building block is rotated about and contacted with the center of the concentric circles of the upper illuminating building block and the elastic piece 223 projected out of the elongated hole 411A disposed at the side of the hollow stud 411 of the lower illuminating building block is moved along and contacted with the outer circumference of the concentric circles of the upper illuminating building block. During the process of rotation, the insulating coating 211 prevents the elastic piece 223 projected out of the elongated hole 411A disposed at the side of the hollow stud 411 of the lower illuminating building block from being simultaneously contacted with the electrode circuit 21 disposed at the outer circumference and the electrode circuit 21 disposed at the opening (the positive and negative electrode circuits) of the upper illuminating building block, which results in failure of the electric connection.

Referring to FIG. 6, the elastic piece 223 is a circular arc piece. One end of the circular arc piece is connected with the connection portion 222 and a top of the circular arc piece is projected out of the hollow stud 411. Therefore, when the illuminating building blocks are connected with each other, the recesses 11 of the upper illuminating building block are engaged with the studs 411 of the lower illuminating building block and the elastic pieces 223 projected out of the hollow studs 411 are pressed against and contacted with a bottom of the electrode circuits 21, thereby electrically connecting the upper illuminating building block with the lower illuminating building block and making both of the illuminating blocks capable of emitting light.

Figure 7:
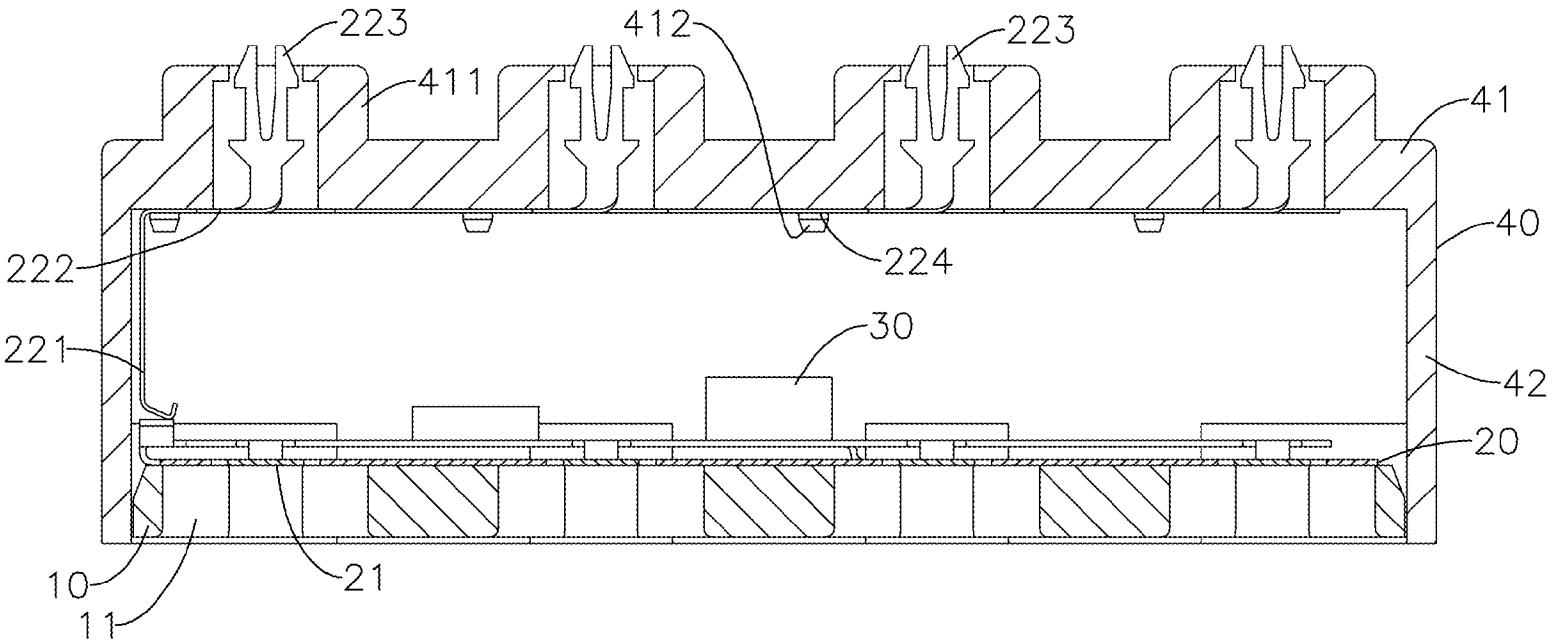
FIG. 7 is a side cross-sectional view showing an illuminating building block with high light transmission according to a third preferred embodiment of the present invention.

Referring to FIG. 7, an elastic piece 223 according to a third preferred embodiment is an elongated piece. Each of the elongated pieces has one end connected with the connection portion 222 and is extended from the connection portion 222 in a direction away from the circuit board 20. A free end of the elongated piece is shaped in a fork and two tips of the fork are right triangles. The tips of the free end of the elastic piece 223 are projected out of the hollow stud 411. Therefore, when the illuminating building blocks are connected with each other, the recesses 11 of the upper illuminating building block are engaged with the studs 411 of the lower illuminating building block and the elastic pieces 223 projected out of the hollow studs 411 are contacted with the bottom of the electrode circuits 21, thereby electrically connecting the upper illuminating building block with the lower illuminating building block and making both of the illuminating blocks capable of emitting light.

Figure 8:
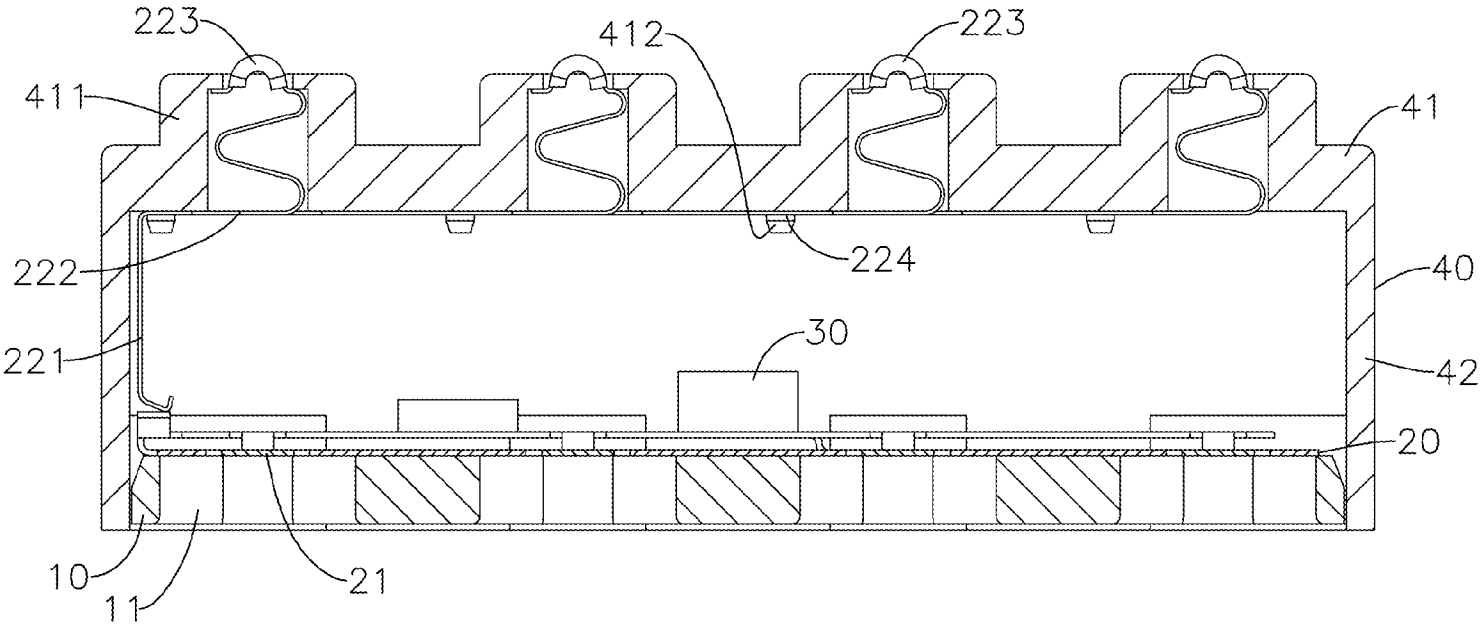
FIG. 8 is a side cross-sectional view showing an illuminating building block with high light transmission according to a fourth preferred embodiment of the present invention.

Referring to FIG. 8, an elastic piece 223 according to a fourth preferred embodiment is a curved piece. Each of the curved pieces has three U-shaped turns arranged along an extension direction of the hollow stud 411. The elastic piece 223 includes one end connected with the connection portion 222 and another end having a curved portion projected out of the hollow stud 411. Due to the U-shaped turns, the elastic piece 223 is flexible. Therefore, when the illuminating building blocks are connected with each other, the recesses 11 of the upper illuminating building block are engaged with the studs 411 of the lower illuminating building block and the elastic pieces 223 projected out of the hollow studs 411 are pressed against and contacted with the bottom of the electrode circuits 21, thereby electrically connecting the upper illuminating building block with the lower illuminating building block and making both of the illuminating blocks capable of emitting light.

Figure 9:
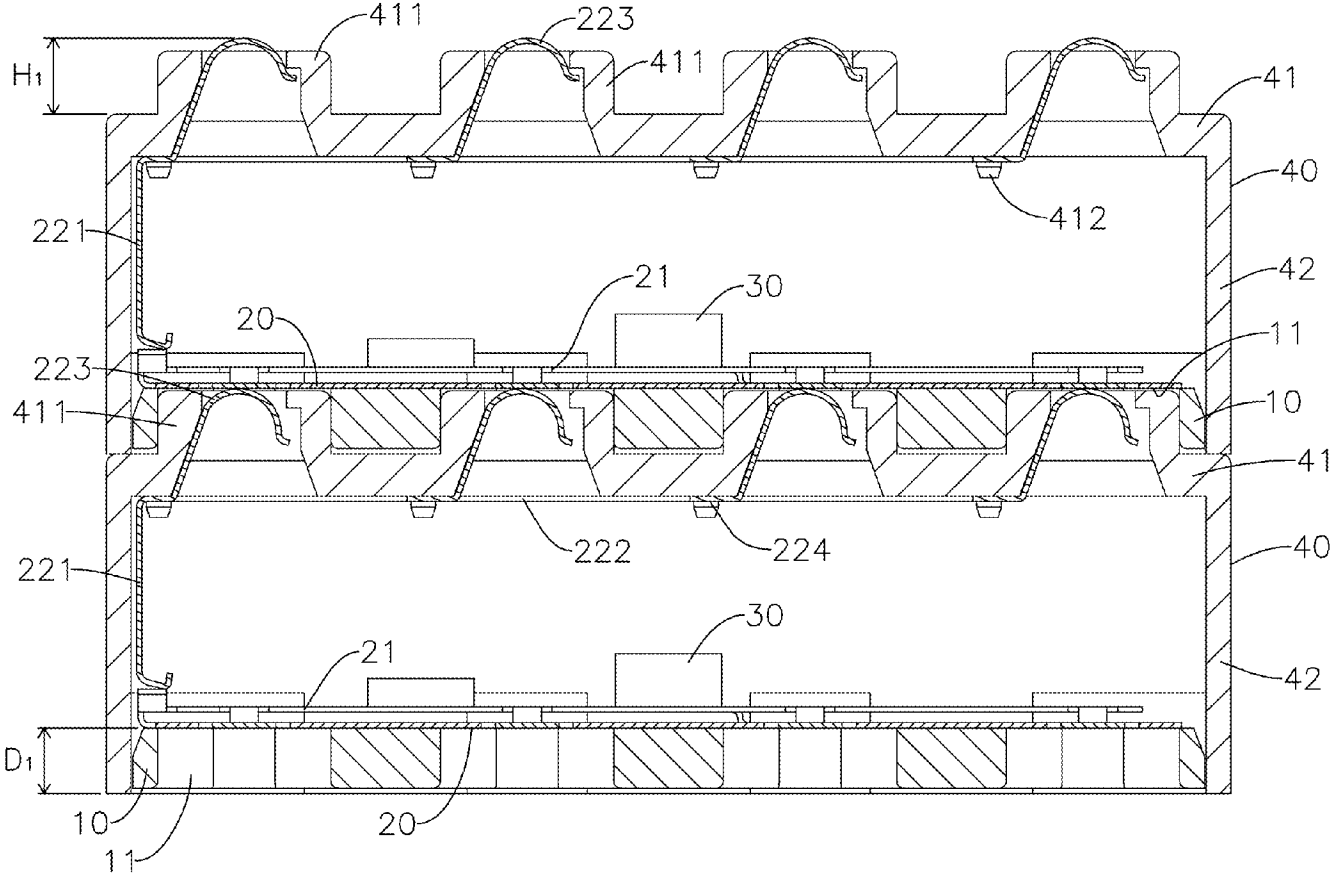
FIG. 9 is a side cross-sectional view showing two of the illuminating building blocks with high light transmission according to the first or second preferred embodiment of the present invention.

FIG. 9 shows two of the illuminating building blocks according to the first or second preferred embodiment of the present invention connected with each other. Because the elastic pieces 223 are projected out of the hollow studs 411, the elastic pieces 223 of the lower illuminating building block is pressed against the circuit board 20 disposed in the upper illuminating building block, thereby electrically connecting the upper illuminating building block with the lower illuminating building block by contact. The deformation of the elastic pieces 223 prevents the electric connection between the two building blocks from being getting loose. Therefore, it is clear that a height H1 of the hollow stud 411 plus a portion of the elastic piece 223 that is projected out of the hollow stud 411 is greater than a depth D1 from a bottom of the recess 11 to the circuit board 20.

Moreover, referring to FIGS. 6 to 10, an inside of the top portion 41 of the top cover 40 further includes a plurality of fixing pieces 412 and the connection portion 222 of the electric connection member 22 includes a plurality of fixing holes 224 corresponding to the fixing pieces 412. Thus, the fixing pieces 412 can be engaged with the fixing holes 224 to connect the electric connection member 22 with the top cover 40.

Figure 10:
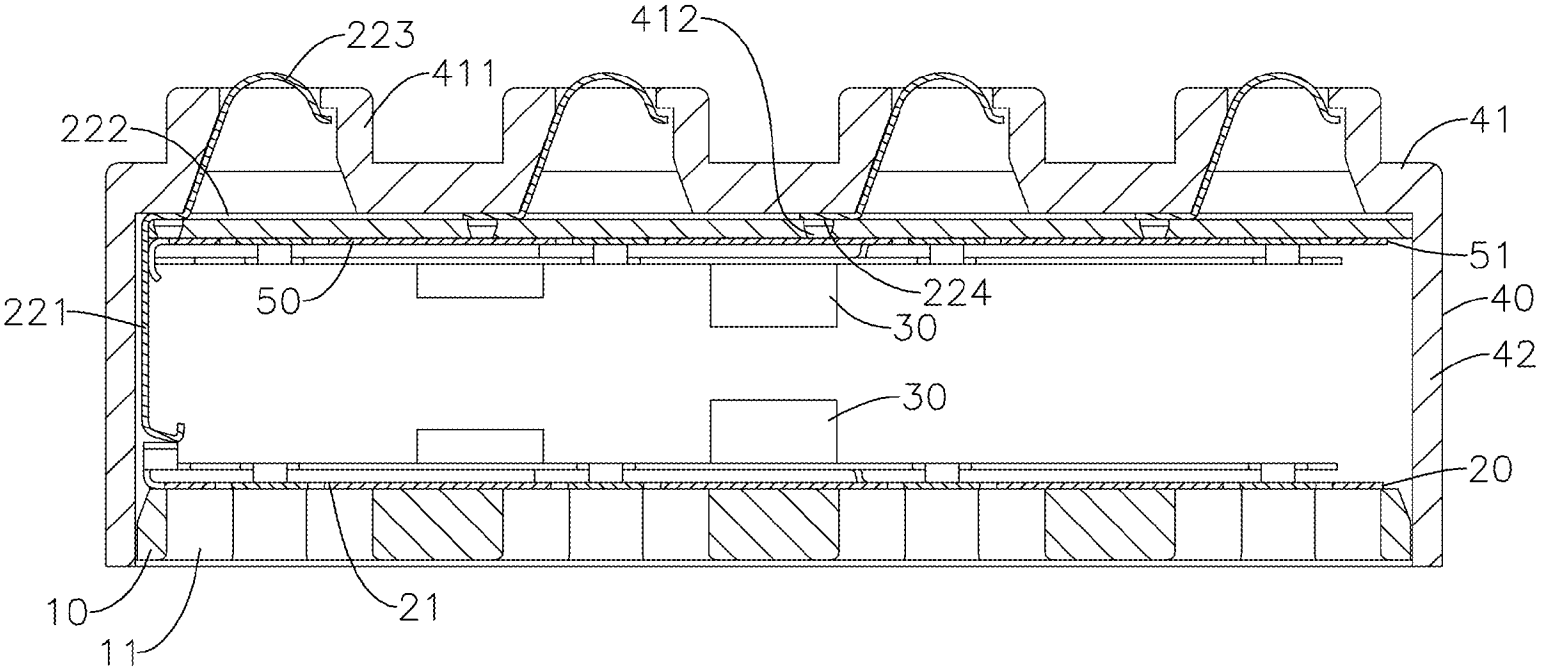
FIG. 10 is a side cross-sectional view showing an illuminating building block with high light transmission according to a fifth preferred embodiment of the present invention.

Referring to FIG. 10, a second circuit board 50 according to a fifth preferred embodiment is further provided at the inside of the top cover 40. The second circuit board 51 includes a plurality of second electrode circuits 51. Each of the second electrode circuits includes a second positive electrode circuit and a second negative electrode circuit. The second positive electrode circuits and the second negative electrode circuits are connected with the electric connection members 22, respectively. The second positive electrode circuits and the second negative electrode circuits of the second circuit board 51 may be arranged in the same way as or in a different way from the positive electrode circuits and the negative electrode circuits 21 of the circuit board 20. The second electrode circuits 51 are electrically connected with another illuminating member 30. Due to the circuit board 20 and the second electrode circuit board 50, the illuminating building block according to the fifth preferred embodiment of the present invention is provided with more illuminating members 30, thereby increasing the luminance of the building block.

Figure 11:
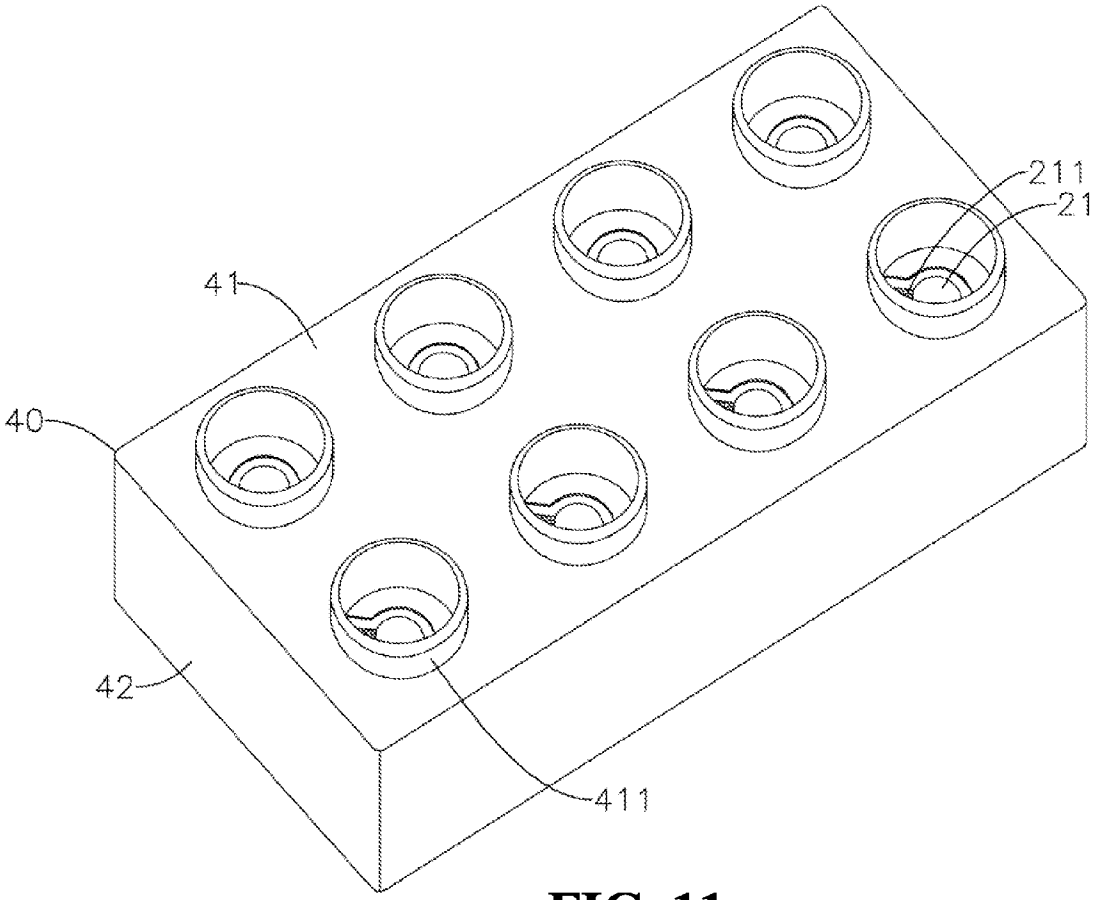
FIG. 11 is a perspective view showing an illuminating building block with high light transmission according to a sixth preferred embodiment of the present invention.
Figure 12:
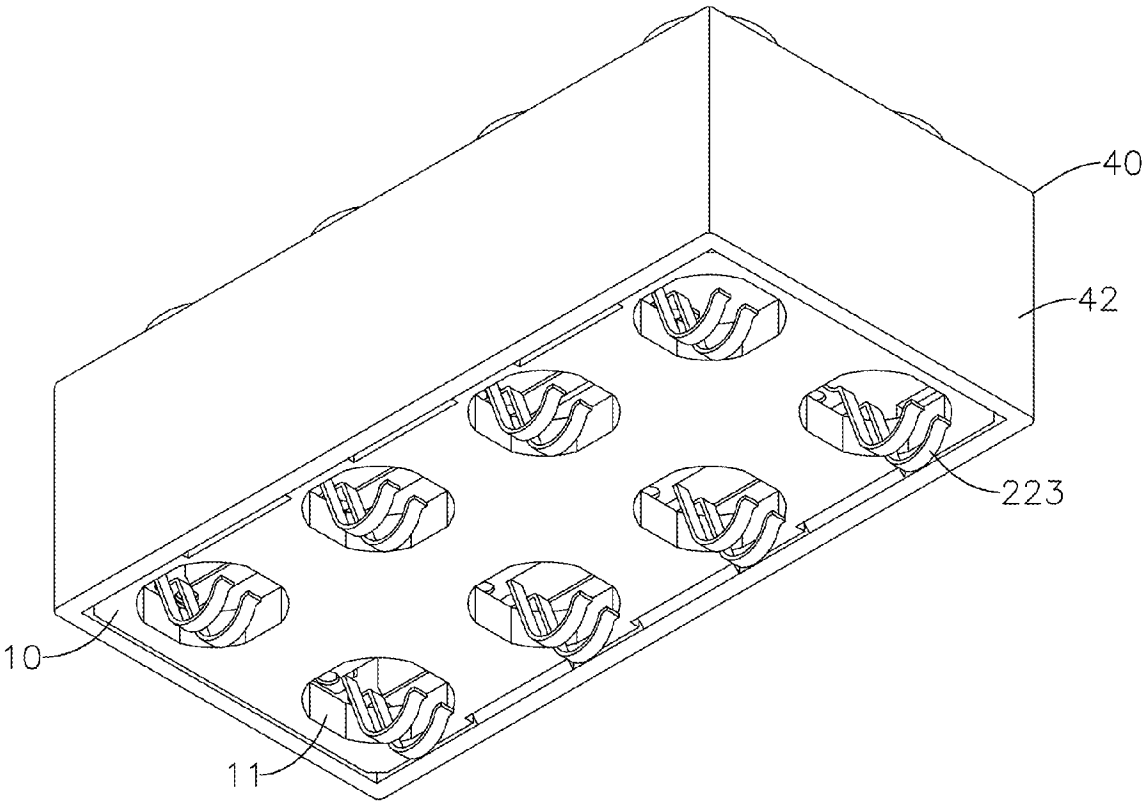
FIG. 12 is a perspective views showing the illuminating building block with high light transmission according to the sixth preferred embodiment of the present invention in another viewing angle.
Figure 13:
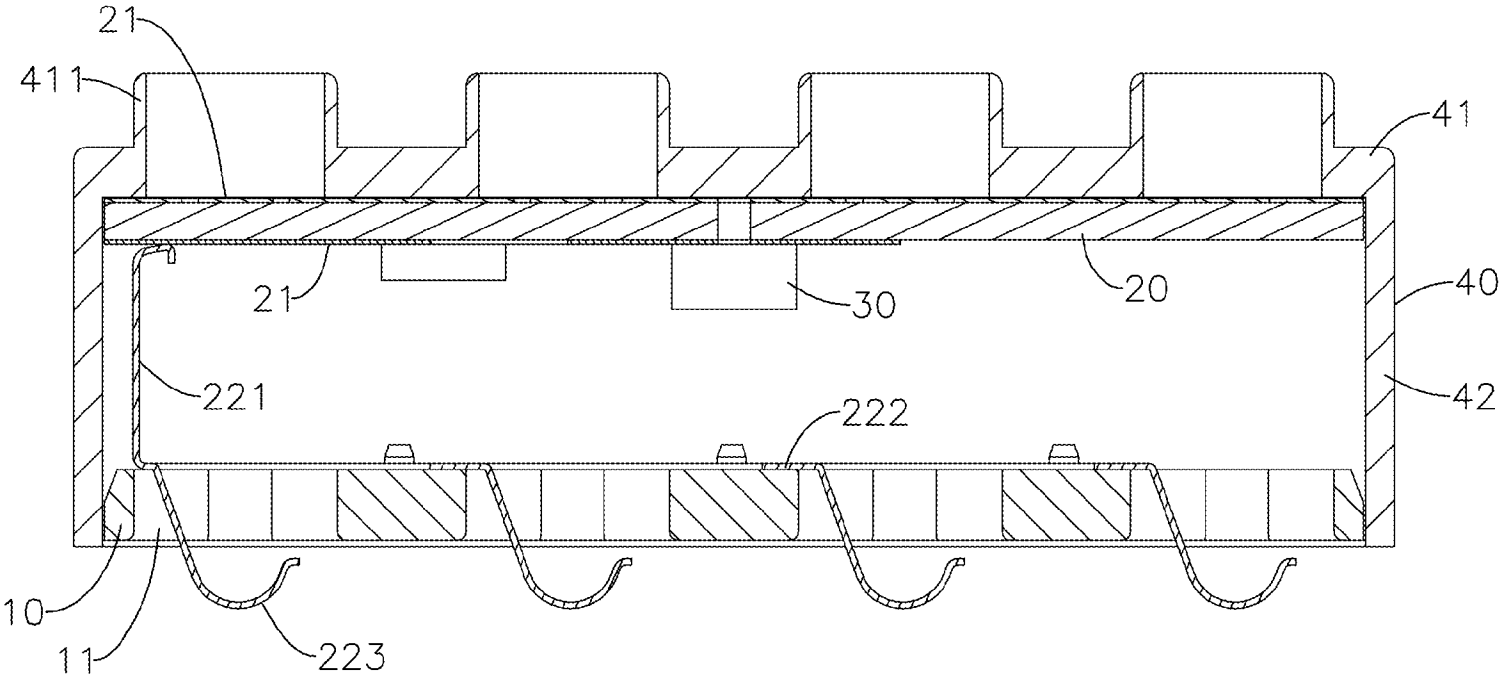
FIG. 13 is a side cross-sectional views showing the illuminating building block with high light transmission according to the sixth preferred embodiment of the present invention.

Referring to FIGS. 11 to 13, an illuminating building block with high light transmission according to a sixth preferred embodiment of the present invention includes a base 10, a circuit board 20, an illuminating member 30 and a top cover 40. Compared with the building blocks according to the first to fifth preferred embodiments, the difference between the sixth preferred embodiment and the other preferred embodiment is the assembling positions of the elements.

The base 10 is also a rectangular plate and includes eight recesses 11 defined therethrough and arranged in a matrix of two by four.

The top cover 40 is also a hollow and light transmittable element. The top cover 40 is mounted on the base 10 and includes a top portion 41 and side walls 42. The top portion 41 of the top cover 40 includes eight hollow studs 411 corresponding to the recesses 11 of the base 10. The side walls 42 are extended from edges of the top portion 41 of the top cover 40 to edges of the base 10.

The circuit board 20 is disposed at an inside of the top portion 41 of the top cover 40 and includes eight units of positive and negative electrode circuits 21 connected in series. Eight units of electrode circuits 21 are corresponding to eight hollow studs 411 of the top cover 40, respectively. Each unit of the positive electrode circuit and the negative electrode circuit are arranged as concentric circles. The electrode circuit disposed at the outer circumference is a hollow loop having an opening. Another electrode circuit disposed at the center of circles is extended through the opening to the outside of the concentric circles. The electrode circuit 21 passing through the opening is covered with an insulating coating 211 at the opening.

Two rows of the positive electrode circuits and the negative electrode circuits are connected with two sets of electric connection members 22, respectively. Each set of electric connection members 22 has two electric connection members 22 that are extended away from the top portion 41 of the top cover 40. Each of the electric connection members 22 includes a projection portion 221, a connection portion 222 and four elastic pieces 223. Moreover, the projection portion 221 is extended away from the top portion 41 and disposed adjacent to the side wall 42 of the top cover 40. One end of the projection portion 221 is contacted with and electrically connected with the electrode circuits 21 and the other end of the projection portion 221 is connected with the connection portion 222, thereby electrically connecting the electric connection member 22 with the circuit board 20. The connection portion 222 is extended adjacent to the base 10 and in a direction parallel to the circuit board 20. The four elastic pieces 223 are distributed along the connection portion 222 and projected from the connection portion 222 in a direction away from the top portion 41 of the top cover 40. Furthermore, elastic pieces 223 are projected out of the recesses 11 of the base 10.

The illuminating member 30 is mounted on the electrode circuits 21 of the circuit board 20. An exterior power source supplies power to the illuminating member 30 through the circuit board 30. Because the electric connection member 22 replaces the electric connection posts of conventional designs and the electric connection members 22 is disposed adjacent to the side wall 42 and the base 10, an open space is provided between the circuit board 20 and the electric connection member 22. The light emitted from the illuminating member 30 would not be blocked.

Figure 14:
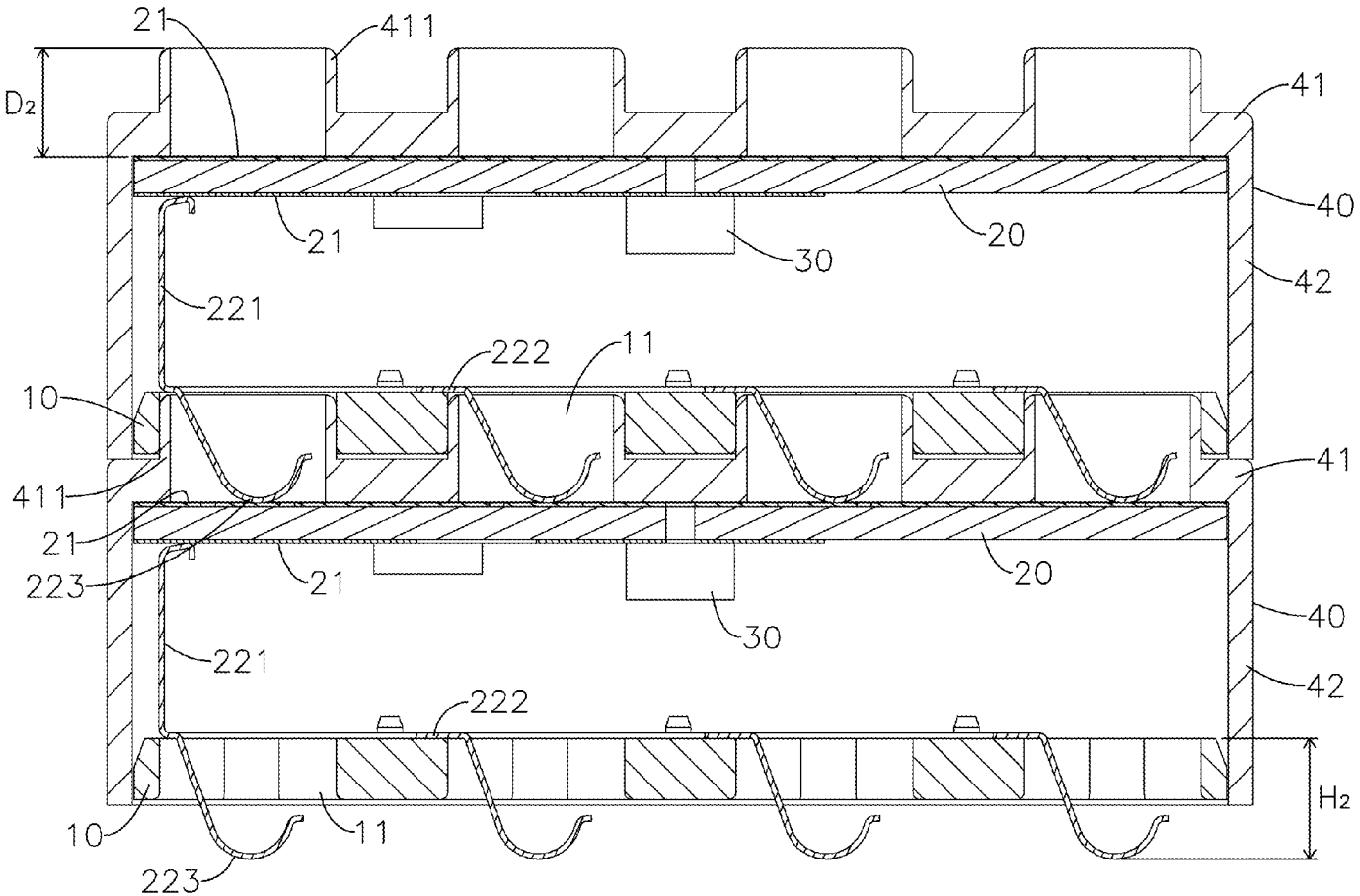
FIG. 14 is a side cross-sectional view showing two of the illuminating building blocks with high light transmission according to the sixth preferred embodiment of the present invention.

FIG. 14 shows two of the illuminating building blocks according to the sixth preferred embodiment connected with each other. Because the elastic pieces 223 of the upper illuminating block are projected out of the recesses 11 of the base 10, the elastic pieces 223 of the upper illuminating block are pressed against the electrode circuits 21 of the circuit board 20 of the lower illuminating building block, thereby electrically connecting the upper illuminating building block with the lower illuminating building block by contact. The deformation of the elastic pieces 223 prevents the electric connection between the two illuminating building blocks from being getting loose. Therefore, it is clear that a height H2 of a depth of the recess 11 plus a height of a portion of the elastic piece 223 that is projected out of the recess 11 is greater than a depth D2 from a top of the hollow stud 411 to the circuit board 20.

In summary, the illuminating building block according to the present invention uses the electric connection members 22 to replace the conventional electric connection posts. The conventional electric connection posts are provided corresponding to the studs and recesses and therefore the conventional electric connection posts are located in the center of the illuminating building block. The electric connection members 22 according to the present invention are disposed adjacent to the top portion 41, the side wall 42 and the base 10 and therefore not disposed in the center of the building block. Thus, the electric connection members 22 not only simplify the structures of the conventional electric connection posts but also prevent the light emitted from the illuminating member 30 from being blocked, which increases the illuminating efficiency of the illuminating building block.

Moreover, when the illuminating building blocks are connected with each other, the characteristic of the deformation of the elastic pieces 223 makes the electric connections between the illuminating building blocks more secure and makes the broken circuits less likely to happen, which effectively prevents the failure of illumination.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. An illuminating building block with high light transmission, comprising:

a base having at least one recess defined therethrough;

a top cover being hollow and light transmittable, mounted on the base, including a top portion and side walls, the top portion including at least one hollow stud corresponding to the recess of the base, the side walls being extended from edges of the top portion to edges of the base;

a circuit board disposed on a top of the base, including at least one electrode circuit corresponding to the recesses of the base, the electrode circuit including a positive electrode circuit and a negative electrode circuit, the positive electrode circuit and the negative electrode circuit respectively connected with a set of electric connection members that are extended away from the base, each of the electric connection members including a projection portion, a connection portion and at least one elastic piece, the projection portion contacted with the electrode circuit of the circuit board, the connection portion connecting the projection portion with the elastic piece, the elastic piece projected into the hollow stud; and at least one illuminating member mounted on the electrode circuit of the circuit board.

2. The illuminating building block as claimed in claim 1, wherein the elastic piece is projected out of the hollow stud of the top cover.

3. The illuminating building block as claimed in claim 2, wherein a height of the hollow stud plus a portion of the elastic piece that is projected out of the hollow stud is greater than a depth from a bottom of the recess of the base to the circuit board.

4. The illuminating building block as claimed in claim 1, wherein the positive electrode circuit and the negative electrode circuit are arranged as concentric circles, the electrode circuit disposed at an outer circumference has an opening and the electrode circuit disposed at a center of the circles are extended through the opening to an outside of the concentric circles.

5. The illuminating building block as claimed in claim 4, wherein the electrode circuit extending through the opening to the outside of the concentric circles is covered with an insulating coating at the opening.

6. The illuminating building block as claimed in claim 1, wherein a second circuit board is further provided at an inside of the top cover, the second circuit board includes at least one second electrode circuit, the second electrode circuit includes a second positive electrode circuit and a second negative electrode circuit, the electric connection members respectively connected with the second positive electrode circuit and the second negative electrode circuit.

7. The illuminating building block as claimed in claim 1, wherein an inside of the top portion of the top cover includes at least one fixing piece and the connection portion of the electric connection member includes at least one fixing holes corresponding to the fixing pieces allowing the fixing pieces being engaged with the fixing holes.

8. An illuminating building block with high light transmission, comprising:

a base having at least one recess defined therethrough;

a top cover being hollow and light transmittable, mounted on the base, including a top portion and side walls, the top portion including at least one hollow stud corresponding to the recess of the base, the side walls being extended from edges of the top portion to edges of the base;

a circuit board disposed at an inside of the top portion of the top cover, including at least one electrode circuit corresponding to the hollow stud of the top cover, the electrode circuit including a positive electrode circuit and a negative electrode circuit, the positive electrode circuit and the negative electrode circuit respectively connected with a set of electric connection members that are extended away from the top cover, the electric connection member including a projection portion, a connection portion and at least one elastic piece, the projection portion contacted with the electrode circuit of the circuit board, the connection portion connecting the projection portion with the elastic piece, the elastic piece projected into the recess; and at least one illuminating member mounted on the electrode circuit of the circuit board.

9. The illuminating building block as claimed in claim 8, wherein the elastic piece is projected out of the recess of the base.

10. The illuminating building block as claimed in claim 9, wherein a depth of the recess plus a height of a portion of the elastic piece that is projected out of the recess is greater than a depth from a top of the hollow stud to the circuit board.

11. The illuminating building block as claimed in claim 8, wherein the positive electrode circuit and the negative electrode circuit are arranged as concentric circles, the electrode circuit disposed at an outer circumference has an opening and the electrode circuit disposed at a center of the circles are extended through the opening to an outside of the concentric circles.

12. The illuminating building block as claimed in claim 11, wherein the electrode circuit extending through the opening to the outside of the concentric circles is covered with an insulating coating at the opening.

13. The illuminating building block as claimed in claim 8, wherein a second circuit board is further provided at a top of the base, the second circuit board includes at least one second electrode circuit, the second electrode circuit includes a second positive electrode circuit and a second negative electrode circuit, the electric connection members respectively connected with the second positive electrode circuit and the second negative electrode circuit.

14. The illuminating building block as claimed in claim 8, wherein a top of the base includes at least one fixing piece and the connection portion of the electric connection member includes at least one fixing holes corresponding to the fixing pieces allowing the fixing pieces being engaged with the fixing holes.

* * * * *